US005832857A

United States Patent [19]

McPherson

[11] Patent Number: 5,832,857

[45] Date of Patent: Nov. 10, 1998

[54] FENDERS

[76] Inventor: Sarah A. McPherson, Rte. 1 Box 609B, Finger, Tenn. 38334

[21] Appl. No.: 677,556

[22] Filed: Jul. 10, 1996

Related U.S. Application Data

[63] Continuation-in-part of Ser. No. 546,033, Oct. 20, 1995, Pat. No. 5,560,312.

[51] Int. Cl.[6] ..... B63B 59/02

[52] U.S. Cl. ..... 114/219; 114/361

[58] Field of Search ..... 114/219, 220, 114/361

[56] References Cited

U.S. PATENT DOCUMENTS 2,577,236 12/1951 Doherty ..... 114/219
2,606,755 8/1952 Samuels ..... 114/219
3,498,252 3/1970 Peacock ..... 114/219

*Primary Examiner*—Jesus D. Sotelo

[57] ABSTRACT

A fender is comprised of a relatively thin, wide, and elongate pad with a central core of resilient material completely enclosed in a durable cover with the cover having flaps that extend beyond the ends of the central core. Grommetted openings are located in the flaps. Cooperating fastening device, such as hook and loop material or snap fasteners, may be located on the inwardly facing surface of the fender with the corresponding fastening device secured to the target attachment surface for the fender in order to preclude motion of the fender once installed thereon. Length adjustable straps have a J-hook on one end that is received within one of the grommetted openings with the opposing end having fastening device thereon for wrapping the straps around a securement object and fastening the strap in a closed loop therearound.

14 Claims, 2 Drawing Sheets

FIG. 1
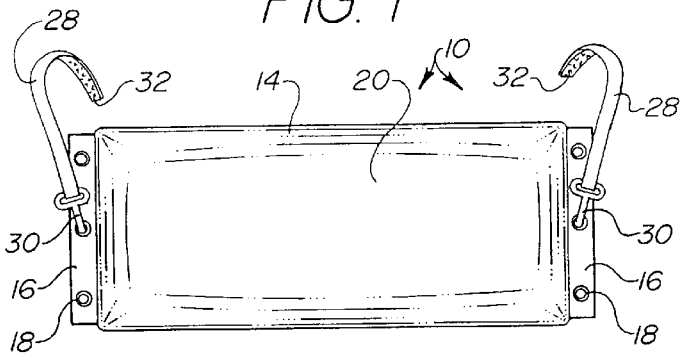
FIG. 2
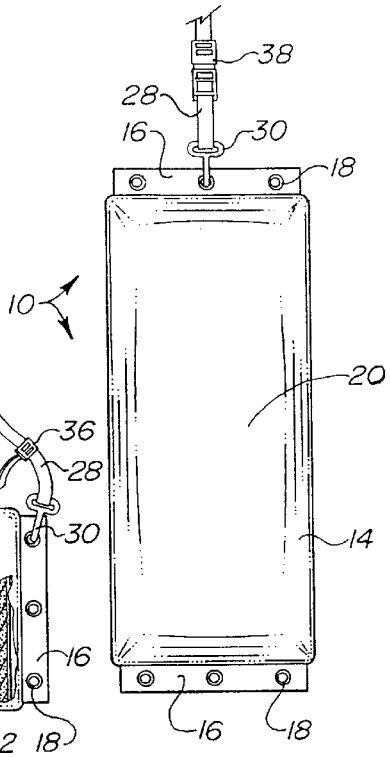
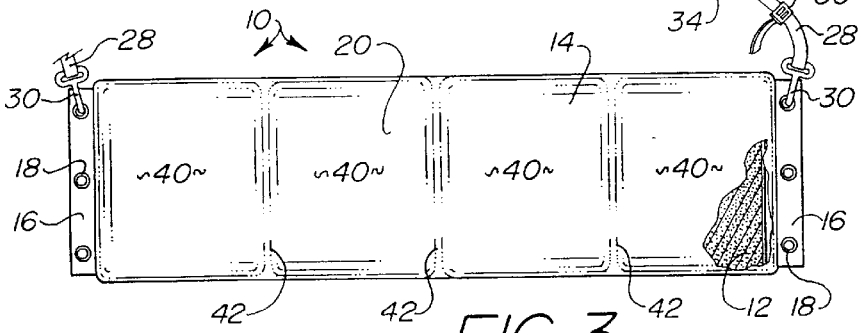
FIG. 3
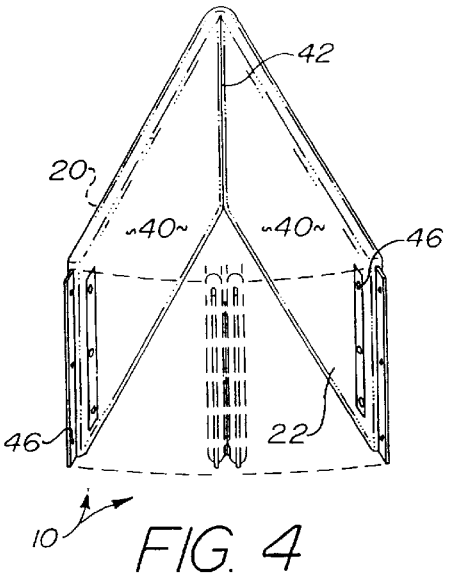
FIG. 4
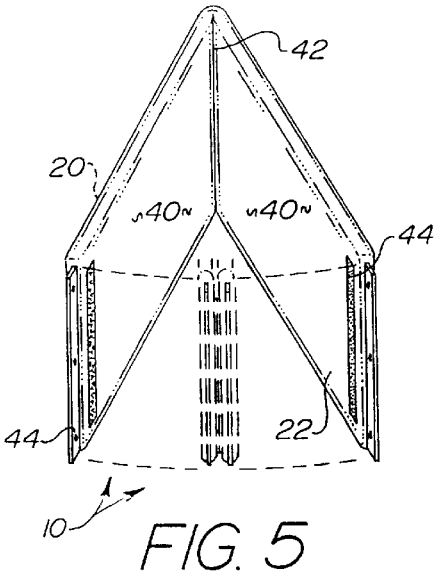
FIG. 5

FENDERS

This is a continuation-in-part of U.S. patent application Ser. No. 08/546,033, filed Oct. 20, 1995, now U.S. Pat. No. 5,560,312.

BACKGROUND OF THE INVENTION

1. Field of the Invention

The present invention relates to protective fenders for various surfaces including watercraft and related surfaces.

2. Background of the Prior Art

The problems associated with current state of the art fenders for various watercraft and mooring and docking surfaces were fully explored in my U.S. patent application Ser. No. 08/546,033, incorporated herein by reference, and will not be repeated herein.

However, I have discovered further needs and desirable features for watercraft fenders not addressed by the prior art devices. Specifically, different watercraft have various heights of gunwales relative to the water surface as well as various distances of fender attachment supports relative to the gunwale. Accordingly, various length adjustment straps are required in order to address these variations in distances.

Furthermore, fenders may need to be disposed either horizontally or vertically depending on the specific watercraft and the docking facilities. Accordingly, the fenders and attachment straps must be able to make such accommodations.

Still furthermore, long docking elements, such as piers, require additional options in compact storage of the fender designed for attachment to the element.

Therefore, watercraft fenders must be designed in order to address such needs.

SUMMARY OF THE INVENTION

The fenders of the present invention address the aforementioned needs in the art. The present fenders provide for selectively adjustable straps that are removably attachable to the fender itself. The straps are attachable to the fender at one of a plurality of attachment points. The straps can be wrapped around a target surface and held in a closed loop therearound by various fastening means including cooperating hook and loop material (Velcro™), snaps, buckles, etc.

The fender may be either horizontally or vertically positioned with respect to the target surface. Furthermore, the straps may extend in any direction from the fender. These features greatly increase the utility of the fender in permitting flexibility of fender positioning and in permitting the straps to be secured to many surfaces irrespective of the surfaces' relative orientation with respect to the fender.

The fenders may be used to protect any suitable surface including watercraft and related surfaces, delivery docking areas, and many others.

BRIEF DESCRIPTION OF THE DRAWINGS

FIG. 1 is a front elevation view of the fender disposed horizontally with removable hooks utilizing hook and loop attachment means.

FIG. 2 is a front elevation view of the fender disposed vertically utilizing buckle means.

FIG. 3 is a front elevation view of the fender of the present invention with collapsing capability.

FIG. 4 is a rear perspective view of the fender partially folded.

FIG. 5 is a rear perspective view with alternate securement means for securing the fender in a folded condition.

Similar reference numerals refer to similar parts throughout the several views of the drawings.

DETAILED DESCRIPTION OF THE PREFERRED EMBODIMENT

Figure 6:
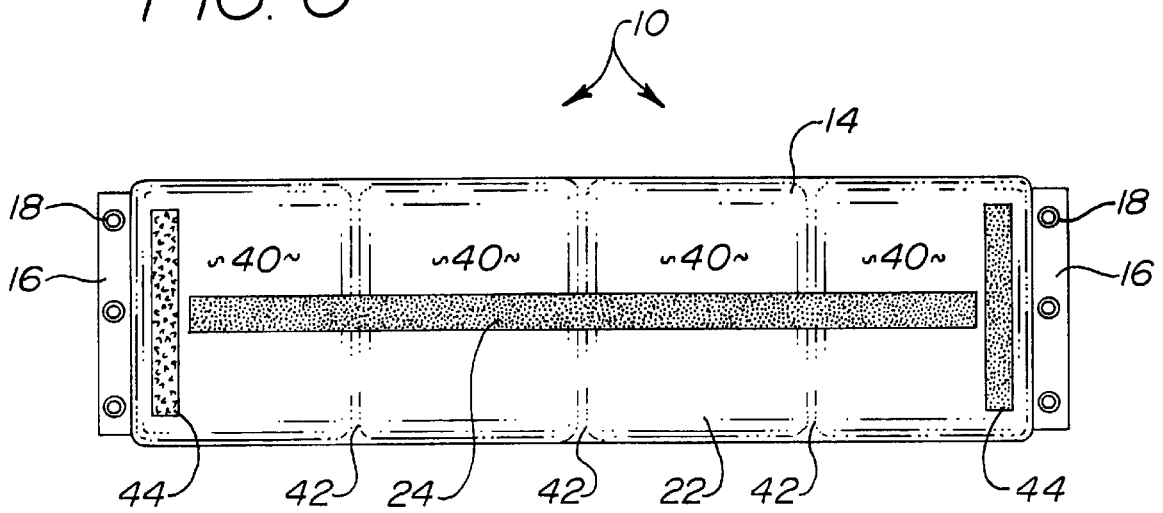
FIG. 6 is a rear elevation view of the fender of the present invention with hook and loop attachment means on the attachment surface.
Figure 7:
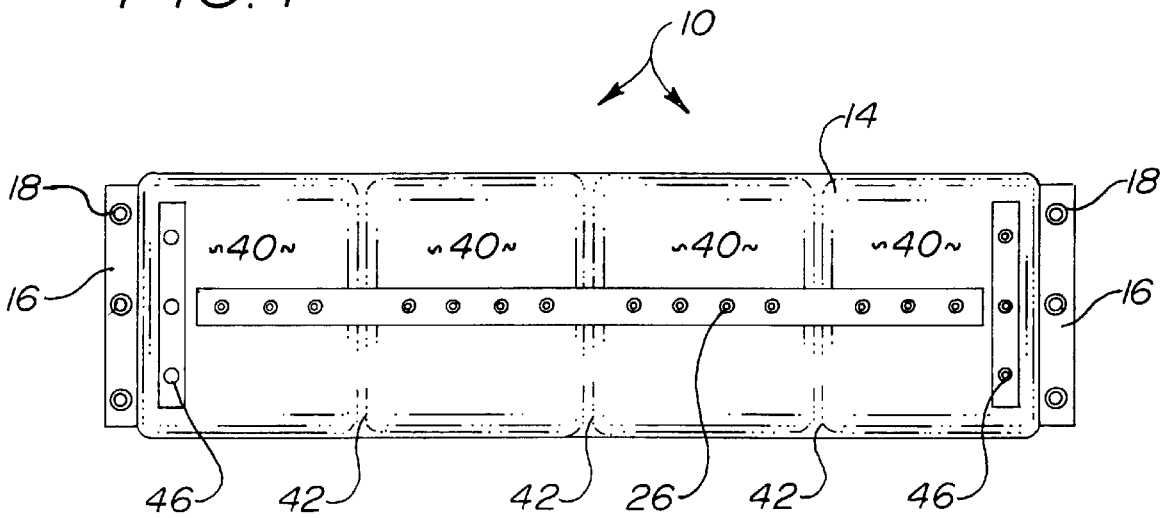
FIG. 7 is a rear elevation view of the fender of the present invention with snap fastener attachment means on the attachment surface.

Referring now to the drawings, it is seen that the fender of the present invention, generally denoted by reference numeral 10, is comprised of a relatively thin, wide, and elongate pad with a central core 12 of resilient material (preferably a closed cell foam material in order to obviate moisture absorption). Although the pad is relatively thin in comparison to many other fenders and bumpers, it is preferably of sufficient thickness as to provide good cushioning characteristics.

The central core 12 is completely enclosed within a thin flexible cover 14 which may be formed of any suitable material. Advantageously, the cover 14 is formed of a synthetic fabric material having good durability and resistance to ultraviolet light and other environmental hazards. A Nylon™ taffeta or heavy gauge of rip stop fabric has proven to be suitable for the present cover.

Flaps 16 of cover material extend outwardly beyond the body of the central core 12. One or more grommetted openings 18 are located on each flap 16 in corresponding position to the openings 18 located on the other flap 16.

The watercraft fender 10 has an outwardly facing engagement surface 20 and an opposing inwardly facing surface 22 (toward the watercraft or other attachment surface). The inwardly facing surface 22 may include some form of surface attachment means thereon, such as cooperating hook and loop material, registerable with a complementary, mating hook and loop material 22 installed on the outer surface of the target attachment area (e.g. the gunwale of a watercraft or pier) for providing removable attachment of the fender 10 thereon. Alternate attachment means may be provided such as snap fasteners 26 disposed on the inwardly facing surface 22 registerable with complementary mating snap fasteners installed on the outer surface of the target attachment area. The watercraft attachment means secures the fender 10 to the target attachment area such that the fender attachment line (defined by the fastener material) cannot move relative to the attachment surface. Thus, the fender 10 cannot float upward or be weighed downward to expose the target surface. The attachment means may be disposed in continuous length or in broken fashion.

As seen in FIGS. 1 and 2, a strap 28 includes a J-hook 30 on one end and fastening means located on the opposing end. The fastening means are designed to permit the end of the strap 28 to be wrapped around a surface, such as a pier piling or watercraft handrail, and the strap 28 secured to itself via the fastening means to formed a closed loop therearound. The fastening means can include cooperating hook and loop 32 material, cooperating snap fasteners 34, buckle 36, and the like. Located on the medial portion of the strap 28 is a slide buckle (such as a Fastex™ buckle) 38 for selective length adjustment of the strap 28. A plurality of straps 28 are utilizable with the fender 10 of the present invention.

In order to utilize the fender 10 of the present invention, the fender 10 is positioned over the target attachment surface (such as the gunwale of a watercraft, a swim platform, the side of a pier, etc.) If utilized, the surface attachment means of the fender 10 are registered with and mated with the corresponding surface attachment means on the target attachment surface. Two or more straps 28 are utilized with the J-hook 30 of each strap 28 received within the grommetted opening 18. The opposing end of each strap 28 is wrapped around a desired securement object and the fastening means are registerable with and mated with each other, thereby securing the strap 28 around the securement object. The length of each strap is adjusted with the slide buckle 38, as needed.

By using J-hooks 30 on the ends of each strap 28 that are removably receivable within a grommetted opening 18 of the fender 10, the fender 10 may be positioned either horizontally or vertically as desired. Furthermore, the straps 28 may be extended either upwardly (or downwardly) or outwardly, either generally horizontally or sloped, from the positioned fender 10, as desired. More than two straps 28 may be utilized if desired. These features greatly increase the utility of the device 10.

In order to facilitate compact storage of the fender 10, the core material 12 and cover material 14 are divided into a plurality of substantially equal sized segments 40, as indicated by the division lines 42 shown in the cover material 14. This permits the fender 10 to be folded alternately back and forth to provide for the compact storage thereof. The straps 28 may be wrapped around or otherwise secured about the folded fender 10 for compact storage.

Alternately, the fender 10 may be divided into two substantially equal sized segments as indicated by division line 42. The fender may be folded in half for compact storage. Fastening means, such as cooperating hook and loop material 44 or cooperating snap fasteners 46 may be located on either end of the fender 10 and for registering and mating with one another for securing the fender 10 in folded configuration.

While the invention has been particularly shown and described with reference to an embodiment thereof, it will be appreciated by those skilled in the art that various changes in form and detail may be made without departing from the spirit and scope of the invention.

I claim:

1. A fender comprising:

a thin, wide, and elongate core of resilient material having a pair of opposing ends;

a thin, flexible cover completely surrounding the core of resilient material having an inwardly facing attachment surface and an opposite outwardly facing surface;

a pair of flaps, integral with the cover, extending beyond the pair of opposing ends;

one or more grommetted openings located on each flap;

a plurality of straps, having a medial portion, a first end and a second end, each strap having a J-hook on the first end and a first attachment means located on the second end; and whereby each J-hook is received within one of the grommetted opening and the opposing end is wrapped around a securement object and fastening the strap in a closed loop therearound.

2. The device as in claim 1 further comprising a second attachment means located on the attachment surface defining a fender attachment line and adapted to attach the fender removably along the attachment surface of a target surface that has a cooperating attachment means, such that the fender is precluded from movement relative to the attachment surface once removably attached thereto.

3. The device as in claim 1 further comprising a slide buckle located on the medial portion of each strap for selectively adjusting the length of the strap.

4. The device as in claim 1 wherein each of the first attachment means is comprised of cooperating hook and loop material.

5. The device as in claim 1 wherein each of the first attachment means is comprised of cooperating snap fasteners.

6. The device as in claim 1 wherein each of the first attachment means is comprised of a buckle.

7. The device as in claim 2 wherein the second attachment means and the cooperating attachment means each comprise a line of cooperating hook and loop material.

8. The device as in claim 7 wherein the line of cooperating hook and loop material is unbroken.

9. The device as in claim 2 wherein the second attachment means and the cooperating attachment means each comprise a line of cooperating snap fasteners.

10. The device as in claim 1 wherein:

the core of resilient material is divided into a plurality of separate segments of substantially equal size and said cover includes a division between each of the core segments and is foldable along each of the divisions.

11. The device as in claim 1 wherein:

the core of resilient material is divided into a pair of separate segments of substantially equal size and said cover includes a division between the core segments and is foldable along the division.

12. The device as in claim 11 further comprising a second attachment means located on the pair of ends of the cover proximate the flaps.

13. The device as in claim 1 wherein the core of resilient material is a closed cell foam material.

14. The device as in claim 1 wherein the cover in Nylon fabric material.

* * * * *